US005433327A

United States Patent [19]

Benvenuti et al.

[11] Patent Number: 5,433,327

[45] Date of Patent: Jul. 18, 1995

[54] MERCHANDISE DISPLAY RACK WITH REINFORCED BASES

[75] Inventors: Frank Benvenuti, Mercier; Christian Robidoux, Ile Bizard, both of Canada

[73] Assignee: Knape & Vogt Canada, Inc., Etobicoke, Canada

[21] Appl. No.: 97,387

[22] Filed: Jul. 26, 1993

[51] Int. Cl.[6] ..... A47F 5/00

[52] U.S. Cl. ..... 211/193; 108/108; 211/187

[58] Field of Search ..... 211/187, 189, 192, 193; 108/108, 109

[56] References Cited

U.S. PATENT DOCUMENTS

| | | | |
|---|---|---|---|
| 2,956,688 | 10/1960 | Galassi | 108/108 |
| 3,040,905 | 6/1962 | Gingher et al. | 108/108 |
| 3,101,681 | 8/1963 | Streater | 211/187 X |
| 3,186,668 | 6/1965 | Story | 211/187 X |
| 3,570,798 | 3/1971 | Squibb | 211/187 X |
| 3,587,867 | 6/1971 | Fenwick | 211/187 X |
| 3,589,310 | 6/1971 | Tucker | 108/108 |
| 3,601,256 | 8/1971 | Bowers | 211/193 X |
| 3,601,432 | 8/1971 | Fenwick | 211/192 X |
| 3,602,159 | 8/1971 | Marschak | 211/187 X |
| 3,680,711 | 8/1972 | Bruckner | 211/192 X |
| 3,770,135 | 11/1973 | Schield | 211/193 |
| 3,794,281 | 2/1974 | Munsey | 211/192 X |
| 4,108,085 | 8/1978 | Sheperd et al. | 211/187 X |
| 4,646,656 | 3/1987 | Marschak | 108/108 |
| 5,205,421 | 4/1993 | Bustos | 108/108 X |

*Primary Examiner*—Robert W. Gibson, Jr.
*Attorney, Agent, or Firm*—Baker & Botts

[57] ABSTRACT

Disclosed is a merchandise display rack also known as a "gondola", in which each post has a bottom and from which two flat tabs horizontally extend away in the same direction as hookable half-bases used to hold the post vertical. A retaining pin is rigidly connected to each half-base or tab is in such a manner as to engage and fit into a corresponding hole made in the corresponding tab or half-base when this half-base is rigidly connected to the post. As a result, most of the shearing force that usually applies to the lower hooks of the half-bases when the rack is loaded with merchandise onto one size only, is transferred to the tabs by the retaining pins, thereby making it possible for the rack to receive a heavier load on this one size.

15 Claims, 4 Drawing Sheets

MERCHANDISE DISPLAY RACK WITH REINFORCED BASES

BACKGROUND OF THE INVENTION

1) Field of the Invention

The present invention is concerned with an improvement to the kind of merchandise display racks known in the trade as "gondolas", which improvement makes such racks much stronger and thus suitable to bear higher loads.

2) Brief Description of the Prior Art

Gondolas are merchandise display racks that are widely used in retail stores especially food stores, to store and display the merchandises offered for sale. Such racks that are most of time disposed in island formation in the stores, basically comprise two or more vertical posts made of rigid metal, such as steel. Each post has a bottom end and a pair of front and rear surfaces formed with a plurality of vertical aligned apertures for use to detachably secure merchandise shelves through angular brackets in an overhanging fashion.

Two or more horizontal tie bars also made of metal, are used for rigidly interconnecting each pair of posts adjacent each other in spaced apart relationship.

The posts interconnected by the tie-bars are mounted onto the floor by means of transversal footings connected to their bottom ends and sized and positioned to hold the posts vertical even when shelves are secured thereto and loaded with merchandises to be displayed. Each footing is defined by at least one half-bases having a vertical inner edge from which hooks projects, and a vertical outer edge. Each half-bases are rigidly connectable to the post adjacent the bottom end thereof by insertion of its hooks into the apertures made in the front or rear surfaces of this post. When two half-based connected to one post, they horizontally project away in opposite directions from the front and rear surfaces of the post and act as symmetrical stabilizers for holding this post vertical.

This basic structure is quite efficient. However, it has been found that in use, the half-bases and more particularly the hooks that project from such half-bases, must be oversized to sustain shearing forces to which they are subjected, especially when the shelves are loaded in an unbalanced manner. Indeed, in such a case, the posts of the rack are deflected on one side by the unbalanced load and the upper portions of the inner edges of the half-bases that extend on this one side are pressed against the corresponding surfaces of the posts and thus subjected to compression, while simultaneously a substantial tension is exerted through the same posts onto the hooks that project from the lower portions of the inner edges of the same half-bases and are thus subjected to a shearing force.

Such a deflection and resulting shearing forces may be very substantial and limit the load that may be "safely" carried by the gondola. Thus, for example, with a standard 8' high gondola the deflection may be as high as 9/16" with 2 000 lbs. loaded onto one side only.

OBJECTS AND SUMMARY OF THE INVENTION

The object of the present invention is to improve the basic structure of the standard gondolas as disclosed hereinabove, in such a manner that most of the shearing force that usually applies to the lower hooks of the half-bases when the rack is loaded onto one side only, is transferred to horizontal tabs integral to and projecting away from the bottom end of each post, thereby making possible for the rack to "safely" receive a higher load on this one side.

In accordance with the invention the same standard 8' high gondola as mentioned above will be able to be loaded with 3 700 lbs. onto one side only, without undergoing a deflection much greater than the one mentioned hereinabove.

The invention thus provides a merchandise display rack of the type mentioned hereinabove, which is improved in that:

each post comprises a flat tab integral to and horizontally projecting away from the bottom end of said post in the same direction as the corresponding half-base; and retaining pins are rigidly connected to the half-bases or tabs, said pins vertically extending and being sized and positioned to engage and fit into holes made in the corresponding tabs or half-bases when said half-bases are rigidly connected to the post;

whereby most the shearing force that usually applies to the lower hooks of the half-bases when the rack is loaded with merchandise onto one side only, is transferred to the horizontal tabs by the retaining pins, thereby making it possible for the rack to receive a heavier load on said one side.

In a first embodiment of the invention, the retaining pins are rigidly connected to said half-bases close to the inner edges thereof and downwardly project therefrom to engage said holes that are then made in the horizontal tabs.

In a second embodiment of the invention, the retaining pins are rigidly connected to said horizontal tabs and upwardly project therefrom to engage said holes that are then made in the half-bases.

The invention and its advantages will be better understood upon reading of the following non-limitative description of two preferred embodiments thereof, reference being made to the accompanying drawings.

DESCRIPTION OF TWO PREFERRED EMBODIMENTS OF THE INVENTION

Figure 1:
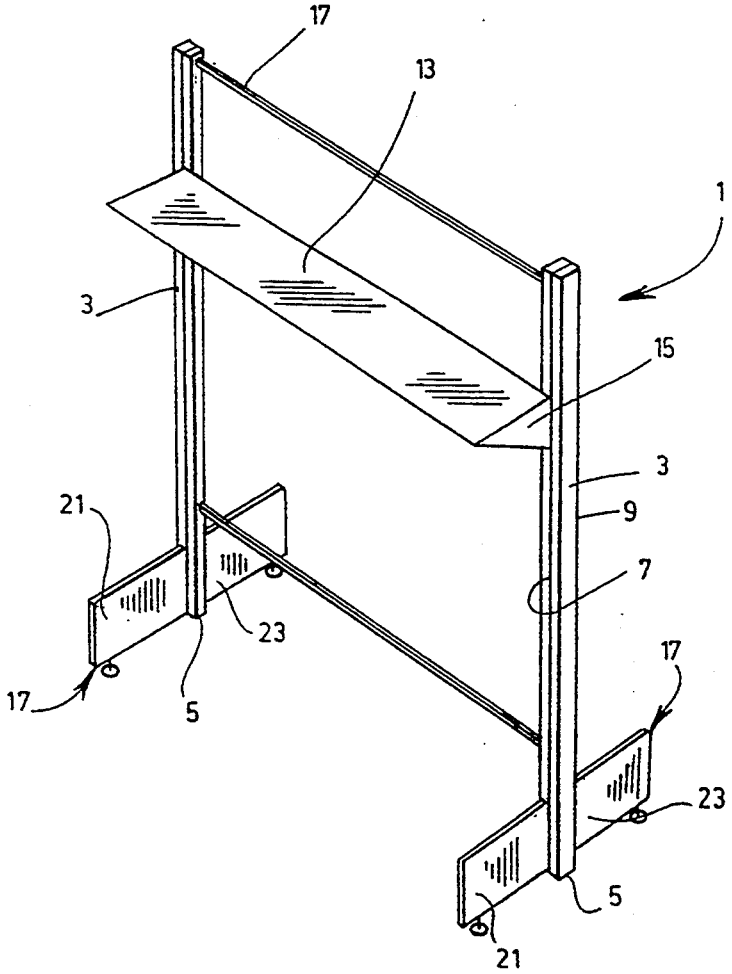
FIG. 1 is a perspective view of a merchandise display rack of conventional structure.

FIG. 1 shows the basic structure of a merchandise display rack 1 that is commonly called "gondola" in the trade.

Such a rack 1 basically comprises two or more vertical posts 3 made of rigid metal, such as steel. Each post 3 has a bottom end 5 and a pair of front and rear surfaces 7, 9 formed with a plurality of vertically aligned apertures 11 (see FIGS. 2 and 3) for use to detachably secure one or more merchandise shelves 13 though angular brackers 15 in an overhanging fashion.

Two or more horizontal tie bars 17 also made of metal, are used for rigidly interconnecting each pair of posts 3 adjacent to each other in spaced apart relationship.

The posts 3 interconnected by the tie-bars 17 are mounted onto the floor by means of transversal footings 19 connected to their bottom ends 5 and sized and positioned to hold the posts vertical even when shelves 13 are secured thereto and loaded with merchandises to be displayed.

Figure 2:
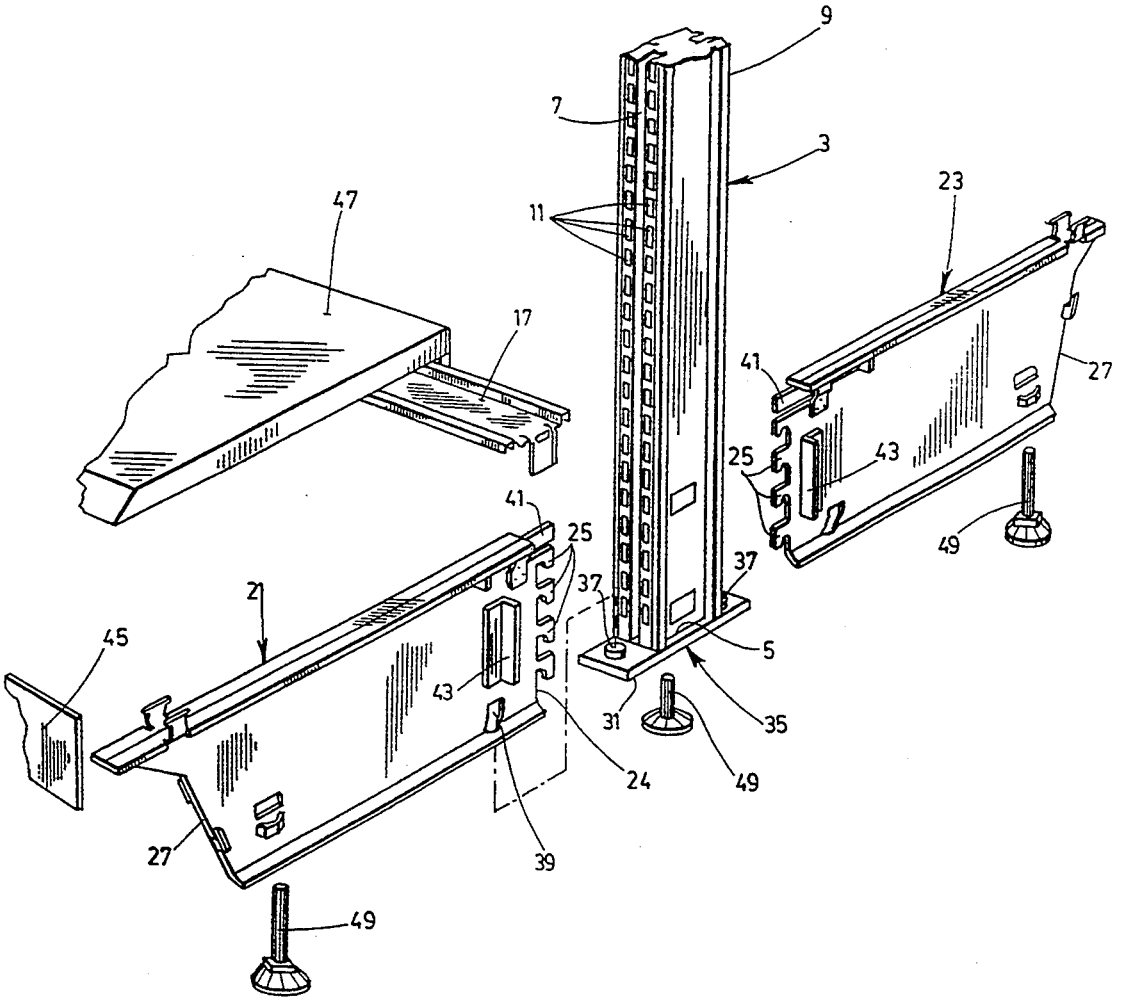
FIG. 2 is an exploded perspective view of the base of a merchandise display rack as shown in FIG. 1, according to a first embodiment of the invention.
Figure 3:
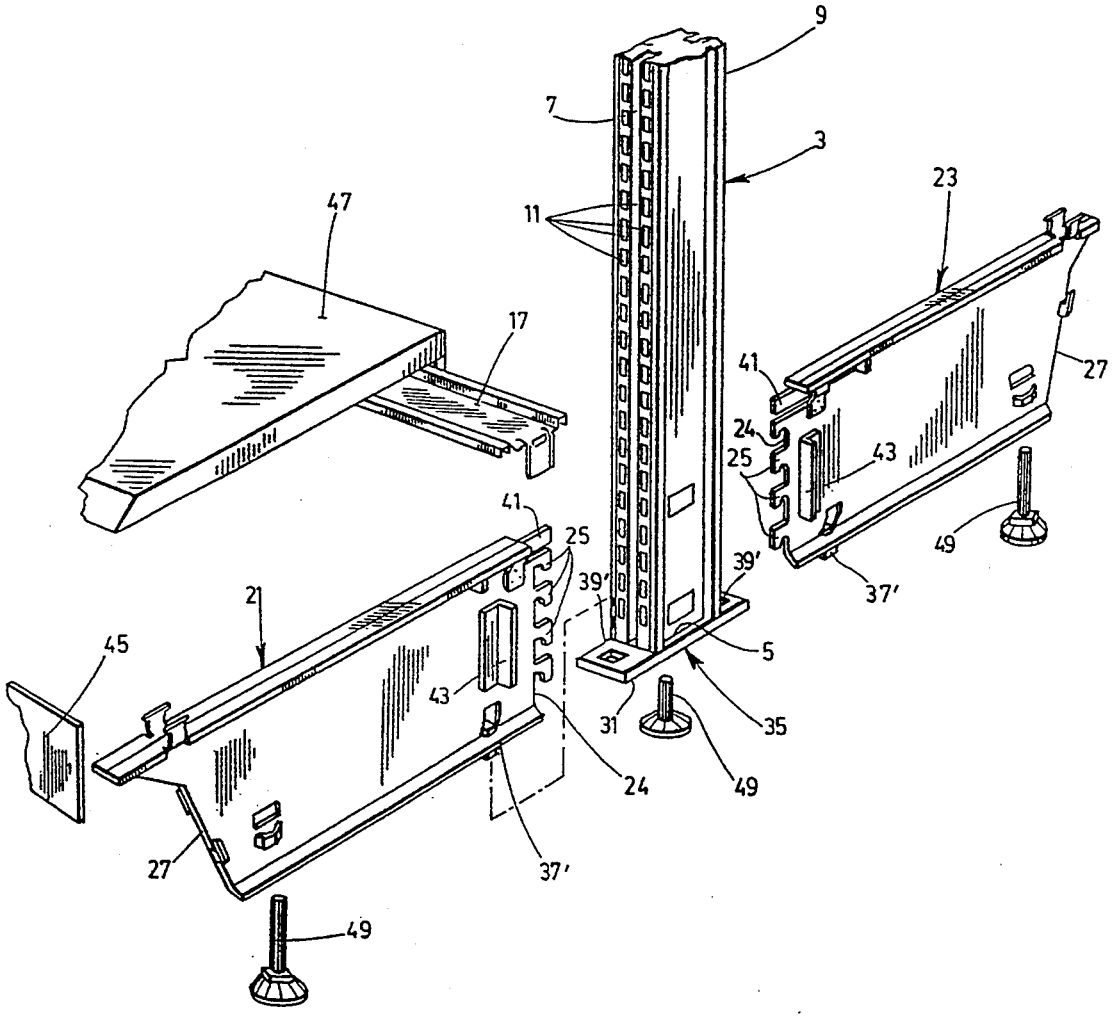
FIG. 3 is a view similar to FIG. 2, showing a second embodiment of the invention.

As better shown in FIGS. 2 to 4, each footing 19 comprises at least one but preferably two of symmetrical half-bases 21, 23, each having a vertical inner edge 24 from which hooks 25 projects, and a vertical outer edge 27. The half-bases 21, 23 are rigidly connected to the post 3 adjacent the bottom end 5 thereof by insertion of their hooks 25 into the apertures 11 made in the front and rear surfaces 7, 9 of this post, respectively. When they are so connected, the half-bases 21 horizontally project away in opposite directions from the front and rear surfaces 7, 9 of the post 3 and act as symmetrical stabilizers for holding this post vertical.

As aforesaid, this basic structure is known per se and no invention is claimed therein.

In accordance with the present invention, each post 3 comprises two flat tabs 31, 33 integral to and horizontally projecting away from the bottom end 5 of the post in the same opposite directions as the corresponding half-bases 21, 23. These tabs may be part of a small plate 35 welded or otherwise attached to the bottom end 5 of the post 3.

Figure 4C:
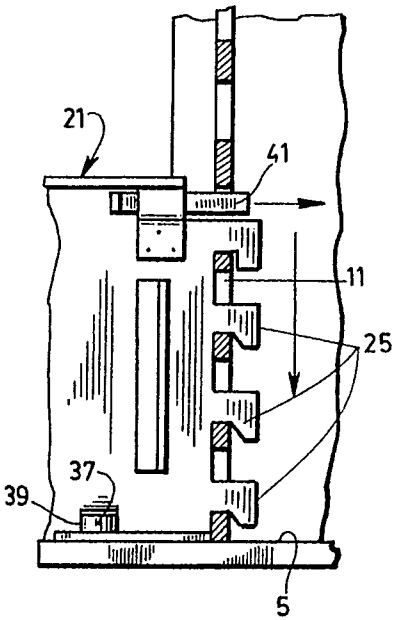
FIGS. 4*a* to 4*c* are side elevational, cross-sectional views of the bottom end of the post of the rack shown in FIG. 2, detailing the procedural steps to be carried out for hooking each half-base to the post.
Figure 4B:
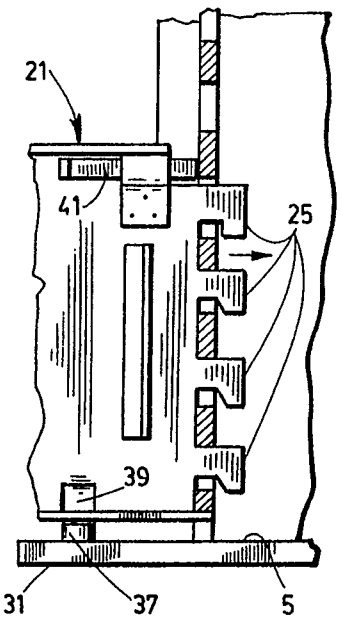
Figure 4A:
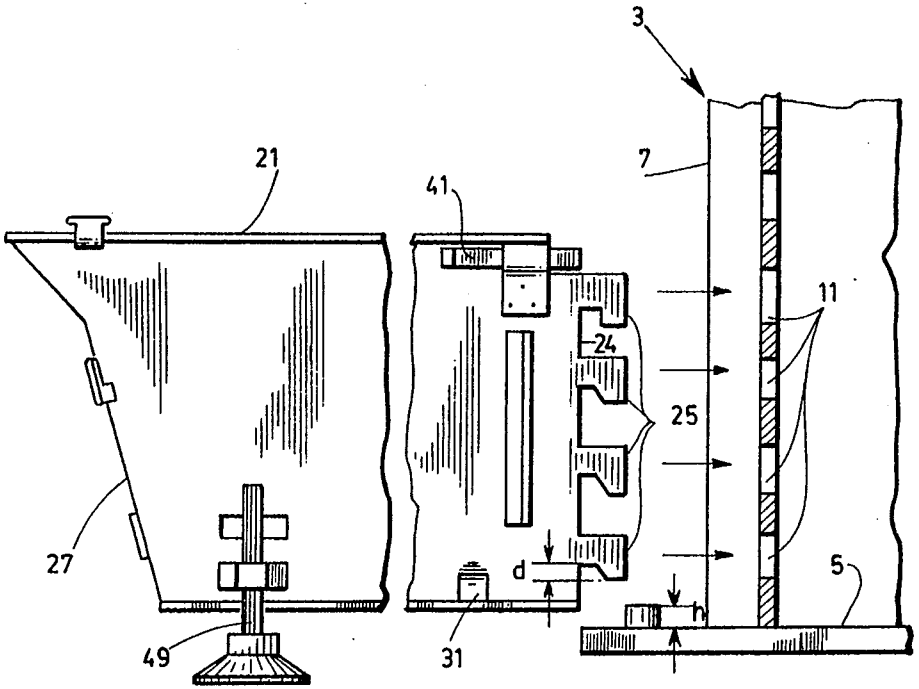

In accordance with a first embodiment of the invention as shown in FIGS. 2 and 4, retaining pins 37 are rigidly connected to the horizontal tabs 31, 33 and upwardly project therefrom to engage holes 39 punched for that purpose in the half-bases 21, 23. More particularly, the retaining pins 37 rigidly connected to the tabs are sized and positioned to engage and fit into the holes or cavities 39 made in the bottom edge 41 of the corresponding half-bases, when these half-bases are rigidly connected to the bottom of the post 3, by longitudinal insertion of their hooks 25 into the apertures 11 (see FIG. 4*a*), followed by vertical sliding of the half-bases down to the tabs (see FIG. 4*b*).

To allow for such an assembly, the height "h" of the pins 37 must of course be identical to or lower than the depth "d" of the hooks 25 (see FIG. 4*a*).

In accordance with a second embodiment of he invention as shown in FIG. 3, the retaining pins 37' are rigidly connected to the half-bases 21, 23 close to the inner edges 24 thereof, and downwardly project therefrom the engage holes 39' that are then made in the horizontal tabs 31, 33.

This second embodiment works in the very same way as the first one. Of course, once again, it is compulsory that the height of the pin does not exceed the depth of he hooks 25 to allow connection of the half-bases as is shown in FIGS. 4*a* and *b*.

In both cases, one can see that, in use, most the shearing force that usually applies to the lower hooks 25 of the half-bases 21, 23 when the rack 1 is loaded with merchandise onto one side only, is transferred to the horizontal tabs 31, 33 by the retaining pins 37, thereby making it possible for the rack to receive a heavier load.

Advantageously, each half-base 21, 23 may be provided with a locking pin 41 slidably mounted onto it adjacent the inner edge 24 thereof above one of the hooks 25. The locking pin 41 is movable in locking position inside the aperture 11 of the corresponding post 3 in which the one hook 25 under the locking pin is inserted after the half-base 21, 23 has been connected to the post 3, as is shown in FIG. 4*c*, in order to prevent this half-base from moving up and out of the apertures and inadvertantly sliding out of the post.

Figure 5:
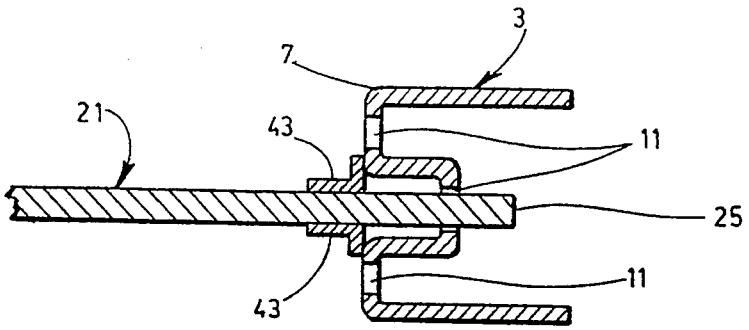
FIG. 5 appering on the same sheet of drwaings as FIG. 1, is transversal, cross-sectional view taken along lines IV—IV of FIG. 3*c*.

Each half-base 21, 23 may also be provided with vertically extending, L-shaped bearing members 43 on both of its sides adjacent its inner edge 24, which come into contact with the front or rear surfaces 7, 9 of the post 3 and help in holding the half-base in line with the post (see FIG. 5).

As is known per se, the above structure may include kick plates 45 (see FIG. 2) detachably connected to the outer vertical edges 27 of each group of two half-bases 21 or 23 projecting away in the same direction from two posts 3 adjacent each other. The above structure may also be completed by a bottom shelf 47 detachably connected to each groups of two half-bases, in such a manner as to bear on top of these half-bases and kick plate 45 connected thereto, and to extend across the same.

Moreover, wooden panels (not shown) may be fixed to the posts 3 and tie bars 17 on both sides thereof to "close" the rack 1 centrally, and height-adjustable levellers 49 may be fixed to the bottom end 5 of each post 3 and adjacent the outer edge 27 of each half-base 21, 23, to make each transversal footing adjustable. As is shown, such levellers may consist of bolts mounted into nuts welded to the posts and half-bases.

Of course, different modifications could be made to the above embodiments without departing from the scope of the present invention as reflected in the appended claims.

What is claimed is:

1. In a merchandise display rack of the type comprising:

at least two vertical posts, each post having a bottom end and a pair of front and rear surfaces formed with a plurality of vertically aligned apertures for use to detachably secure merchandise shelves through angular brackets in an overhanging fashion;

at least two horizontal tie bars per each group of two of said posts adjacent each other for rigidly interconnecting said posts in spaced-apart relationship; and at least one half-base per each post, each half-base having a vertical inner edge from which hooks project and a vertical outer edge, said at least one half-base being rigidly connectable by means of said hooks to the front or rear surfaces of each post adjacent the bottom end thereof, so as to define a traversal footing sized and positioned to hold said one post vertical even when shelves are secured thereto and loaded with merchandises to be displayed, the improvements wherein:

each post comprises a fiat tab integral to and horizontally projecting away from the bottom end of said post in the same direction as the corresponding half-base; and connecting means are provided for rigidly connecting the half-bases to the tabs, said connecting means including vertically extending retaining pins and holes, the holes sized and positioned to engage the retaining pins when said half-bases are rigidly connected to the post, the retaining pins sized and positioned to fit into the holes when said half-bases are rigidly connected to the post, whereby most the shearing force that usually applies to the lower hooks of the half-bases when the rack is loaded with merchandise onto one side only, is transferred to the horizontal tabs by the retaining pins, thereby making it possible for the rack to receive a higher load on said one side.

2. The improved rack of claim 1, further comprising:

a locking pin slidably mounted onto each half-base adjacent the inner edge thereof above one of the hooks, said locking pin being movable into locking position inside the aperture of the corresponding post in which said one hook under the locking pin is inserted after the half-base has been connected to the post, in order to prevent said half-base from inadvertantly sliding out of said post.

3. The improved rack of claim 2, further comprising:

a kick plate detachably connectable to the outer vertical edges of each group of two of said half-bases projecting away in the same direction from two of said posts adjacent each other; and a bottom shelf detachably connectable to each of said groups of two of said half-bases, in such a manner as to bear on top of said half-bases and kick plate connected thereto and extend across said half-bases.

4. The improved rack of claim 2, further comprising:

height-adjustable levellers comprising bolts fixed to the bottom end of each post and adjacent the outer edge of each half-base, to make each transversal footing adjustable.

5. The improved rack of claim 2, further comprising:

height-adjustable levellers comprising bolts fixed to the bottom end of each post and adjacent the outer edge of each half-base, to make each transversal footing adjustable.

6. The improved rack of claim 1, wherein said retaining pins are rigidly connected to said half-bases close to the inner edges thereof and downwardly project therefrom to engage said holes that are then made in the horizontal tabs.

7. The improved rack of claim 2, wherein said retaining pins are rigidly connected to said half-bases close to the inner edges thereof and downwardly project therefrom to engage said holes that are then made in the horizontal tabs.

8. The improved rack of claim 3, wherein said retaining pins are rigidly connected to said half-bases close to the inner edges thereof and downwardly project therefrom to engage said holes that are then made in the horizontal tabs.

9. The improved rack of claim 4, wherein said retaining pins are rigidly connected to said half-bases close to the inner edges thereof and downwardly project therefrom to engage said holes that are then made in the horizontal tabs.

10. The improved rack of claim 5, wherein said retaining pins are rigidly connected to said half-bases close to the inner edges thereof and downwardly project therefrom to engage said holes that are then made in the horizontal tabs.

11. The improved rack of claim 1, wherein said retaining pins are rigidly connected to said horizontal tabs and upwardly project therefrom to engage said holes that are then made in the half-bases.

12. The improved rack of claim 2, wherein said retaining pins are rigidly connected to said horizontal tabs and upwardly project therefrom to engage said holes that are then made in the half-bases.

13. The improved rack of claim 3, wherein said retaining pins are rigidly connected to said horizontal tabs and upwardly project therefrom to engage said holes that are then made in the half-bases.

14. The improved rack of claim 4, wherein said retaining pins are rigidly connected to said horizontal tabs and upwardly project therefrom to engage said holes that are then made in the half-bases.

15. The improved rack of claim 5, wherein said retaining pins are rigidly connected to said horizontal tabs and upwardly project therefrom to engage said holes that are then made in the half-bases.

* * * * *